US005174390A

United States Patent [19]

Kurt

[11] Patent Number: 5,174,390

[45] Date of Patent: Dec. 29, 1992

[54] MODULAR CLUSTER DRILL APPARATUS

[75] Inventor: Ewald H. Kurt, Roanoke, Va.

[73] Assignee: Ingersoll-Rand Company, Woodcliff Lake, N.J.

[21] Appl. No.: 701,852

[22] Filed: May 17, 1991

[51] Int. Cl.[5] ..... E21B 4/16

[52] U.S. Cl. ..... 175/53; 175/96; 175/407; 175/415; 299/62

[58] Field of Search ..... 175/220, 53, 95, 96, 175/203, 390, 391, 406, 407, 415, 417; 299/60, 62

[56] References Cited

U.S. PATENT DOCUMENTS

| | | | |
|---|---|---|---|
| 3,314,724 | 4/1967 | Tinlin | 299/62 |
| 4,410,053 | 10/1983 | Masse | 175/53 |
| 4,729,439 | 3/1988 | Kurt | 175/96 |
| 4,878,547 | 11/1989 | Lennon | 175/53 |

FOREIGN PATENT DOCUMENTS

| | | | |
|---|---|---|---|
| 1406380 | 6/1988 | U.S.S.R. | 175/95 |
| 1062671 | 3/1967 | United Kingdom . | |

*Primary Examiner*—Terry L. Melius

*Attorney, Agent, or Firm*—Glenn B. Foster; John J. Selko

[57] ABSTRACT

A cluster drill includes a first plate portion and a second plate portion. The first plate portion extends parallel to the second plate portion and is rigidly affixed to the second plate portion. At least one first and second plate aperture is formed in the first and second plate, respectively. At least one modular retainer unit, to be mounted within the first and second plate apertures, retains a first and second portion of a rock drill apparatus. A cannister affixes the first plate portion relative to the second plate portion. The cannister may be either cylindrical or contain protuberances to accommodate the modular retainer unit. A drill bit lock restricts motion between the a drill bit and the second plate when desired.

13 Claims, 3 Drawing Sheets

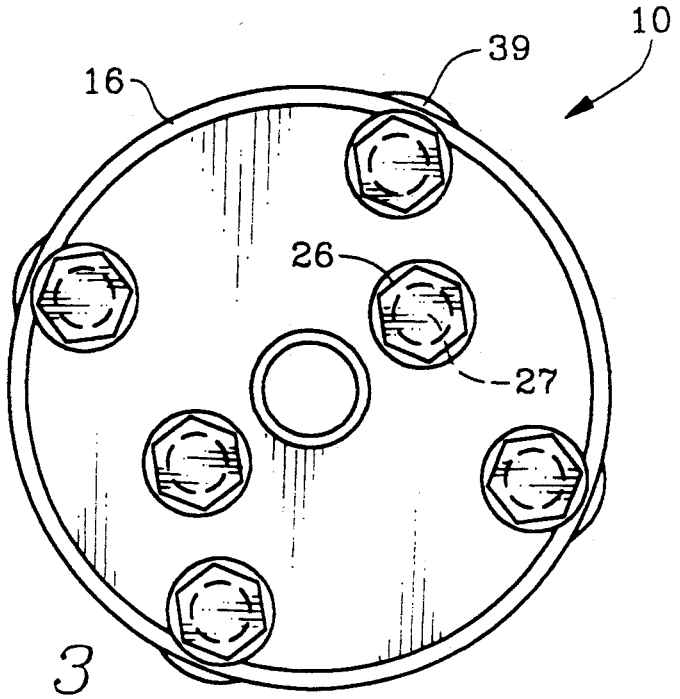
FIG. 3
FIG. 4
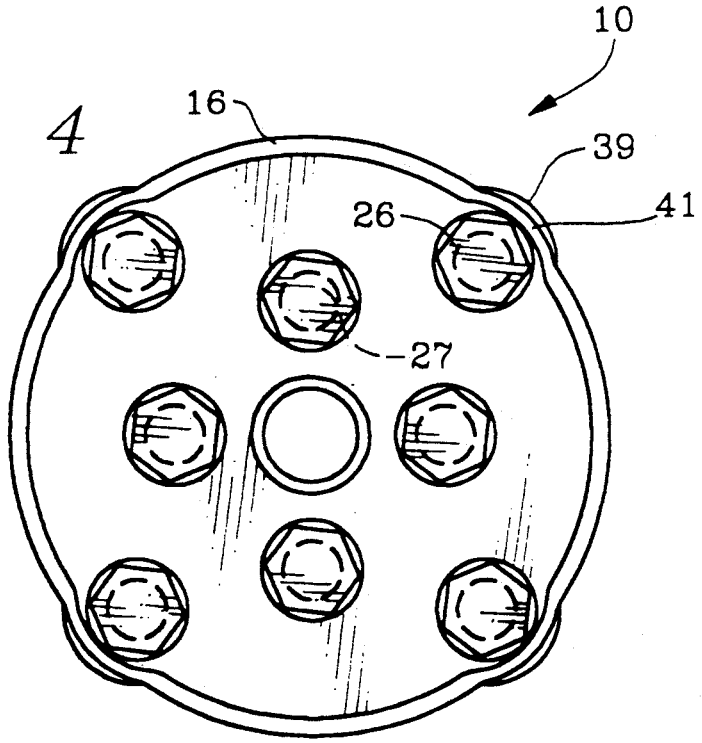

MODULAR CLUSTER DRILL APPARATUS

BACKGROUND OF THE INVENTION

This invention relates generally to a cluster drill or reamer and more particularly to a cluster drill or reamer in which the drilling elements are contained in modular units.

Presently, certain cluster drills and reamers are constructed from a plurality of rock drill apparatus connected by machined end portions. To machine the end portions is extremely expensive and time consuming. It may take many months to produce a suitable machined end portion for a given order on a cluster drill assembly.

The end portions are also extremely heavy. This weight adds extra design problems and considerations for the drilling or reaming assembly. The heavy end portions are required to properly support the actual drill apparatus.

Customers for cluster drill and reamers require considerably different configurations and contours. For this reason, it is desirable to maintain a low inventory of parts and produce cluster rock drills only when the demand arises. Since the present cluster drill structures require such a long time to machine, meeting cluster drill demand by cluster drill production presents problems.

The foregoing illustrates limitations known to exist in present cluster drill assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a modular retainer for use in a rock drill including a first attachment device at a first end of the retainer for retaining a first portion of a rock drill apparatus therein and for attachment to a first plate portion of the cluster drill. A second attachment portion at a second end of the retainer for retaining a second portion of the rock drill apparatus therein and for attachment to a second plate portion of the cluster drill.

The foregoing and other aspects will become apparent from the following detailed description of the invention when considered in conjunction with the accompanying drawing figures.

BRIEF DESCRIPTION OF THE DRAWING FIGURES

FIG. 3 is a view taken along section line 3—3 of FIG. 2;

FIG. 4 is a view similar to FIG. 3 of a cluster reaming apparatus of a different configuration;

DETAILED DESCRIPTION

Figure 1:
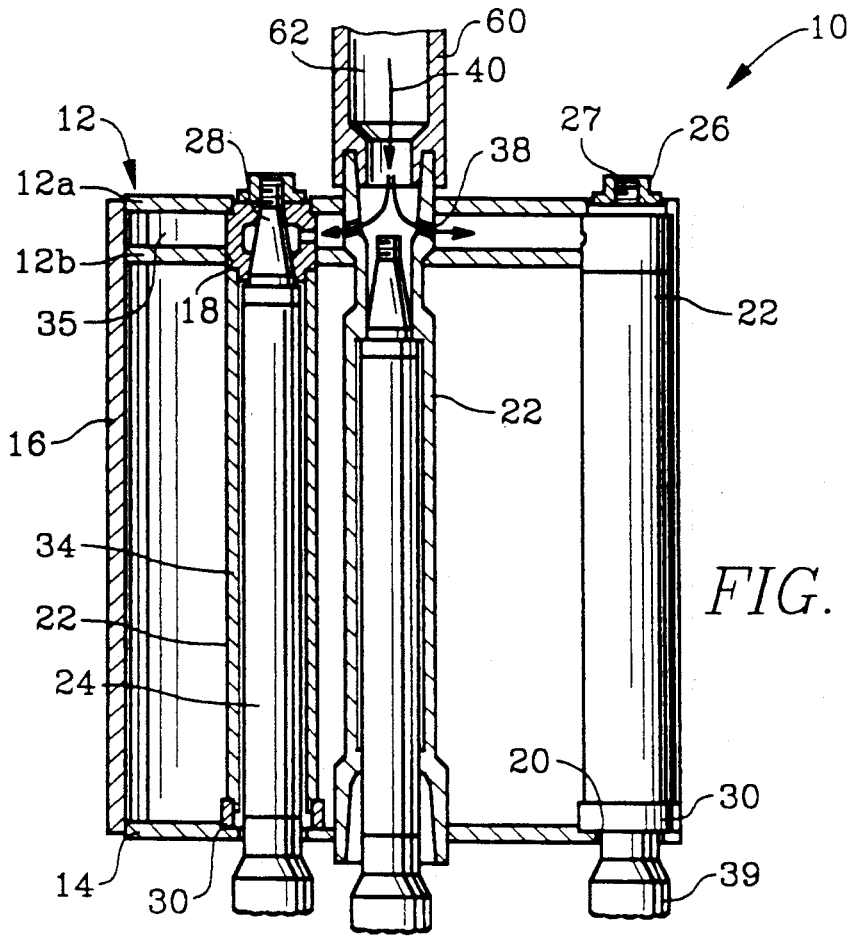
FIG. 1 is a side partial cross sectional view illustrating an embodiment of cluster drilling apparatus of the present invention.

In the present disclosure, identical reference characters will be assigned to identical elements in different embodiments.

A cluster drill or reamer apparatus is illustrated generally as 10. The cluster drill apparatus includes a first plate portion 12 and a second plate portion 14. A circumferential cannister 16 rigidly connects the first plate portion 12 to the second plate portion 14. The circumferential cannister may or may not be used in the present application. The cluster drill apparatus may be used either in drilling applications or in reaming applications, as will be described in this specification.

One or more first plate apertures 18 are formed in the first plate portion 12. Below each first plate aperture 18 in the second plate portion 14 is formed a second plate aperture 20. A modular retainer unit 22 extends between each pair of first plate apertures 18 and second plate apertures 20 the modular retainer unit 2 functions to retain a rock drill apparatus 24 in position.

The first plate apertures 18 and the second plate apertures 20 are may be formed either by burning a hole in the respective plate portion 12 and 14, or by machining. The modular retainer unit 22 is easily affixed to the plate apertures 18, 20 by welding, mating threads or other means of attachment which are well known in the art.

It is generally simpler, and more attachment systems are available, to attach the modular retainer unit to the plate than to attach a drilling apparatus of the prior art to an upper and lower portions of the prior art cluster drill apparatus.

The modular retainer unit 22 contains a first attachment means 26 which restricts excess upward motion of the first drilling element portion 28 relative to the first plate portion 12. A second attachment means 30 affixes a second drilling element portion 32 to the second plate portion 14. A tubular portion 34 extends between the first attachment means 26 and the second attachment means 30 to relatively position the two attachment means 26, 30.

The tubular portion 34 provides added support between the first plate portion 12 and the second plate portion 14. The rock drill apparatus is contoured to fit within the tubular portion 34. Especially in cluster drill apparatus 10 which lack the circumferential cannister 16, the tubular portion reduces wear to the rock drill apparatus 34 by cut material and other abrasives.

Use of the first attachment means 26 and the second attachment means 30, as compared to the prior art slab-like machined attachment elements (as illustrated in U.S. Pat. No. 4,729,439, incorporated herein by reference), greatly simplifies the construction process. Similar attachment means 26, 30 are to retain similar rock drill apparatus regardless of the contour and number of rock drill apparatus per cluster drill apparatus. It is much quicker, simpler and less costly to machine relatively small attachment means 26, 30 of the present invention than the above referenced slab-like prior art attachment elements.

Using modular retainer units 22 as mentioned above permits stocking of the attachment means 26, 30 and the tubular portion 34 regardless of the specific size of cluster drill or reamer apparatus which the customer orders. This is not possible with the prior art configuration and permits rapid assembly and delivery of cluster drill or reamer units 10.

Either attachment means 26 or 30 may be used to connect a plurality of plates 12*a* and 12*b* to form a single plate portion 12. In this manner, the slab-like construction of the prior art is replaced by a much lighter plate construction which is also easier to machine and easier to adapt to different cluster drill configurations.

A void 35 which is formed between plates 12*a* and 12*b* forms a fluid conduit to supply air to the rock drill apparatus 24. This configuration eliminates much of the machining required for air supply conduits in the above referenced slab-like construction.

Figure 2:
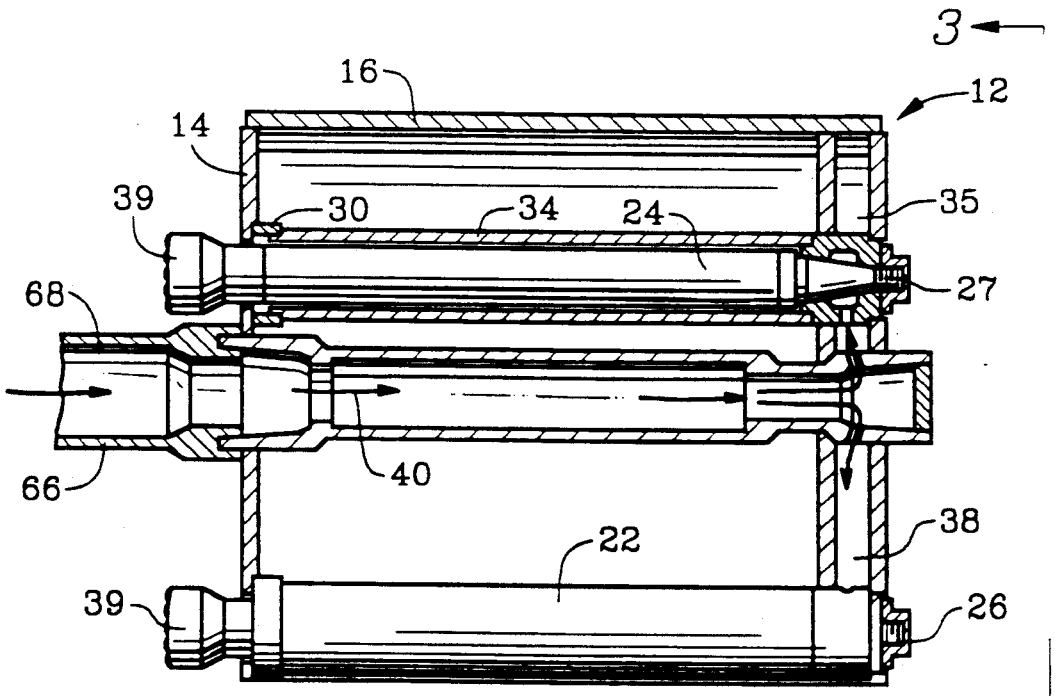
FIG. 2 is a side partial cross sectional view illustrating an embodiment of cluster reaming apparatus of the present invention.
Figure 5:
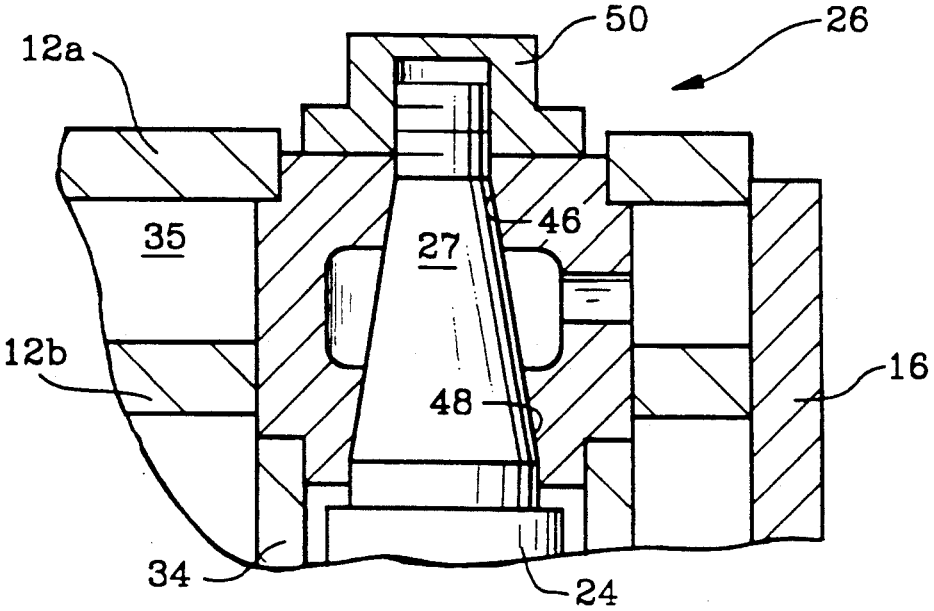
FIG. 5 is an exploded side cross sectional view illustrating the attachment means to the upper plate portion illustrated in FIG. 1.

As illustrated in FIGS. 1,2 and 5, the first attachment means 26 is attached to a backhead 27 of the rock drill apparatus 24. A portion of the first attachment means 26 is formed as a female tapered recess 46 which interacts with a drill mating portion 48 formed in the rock drill apparatus 24. A drill bolt 50 is applied to a threaded portion of the rock drill apparatus 24 to retain it in position.

The assembly of the cluster drill apparatus 10 is as follows. Initially, the upper and lower plates are formed using either machining o burning to form the first and second plate apertures 18, 20. Next, the modular retainer units 22, which have been previously assembled with the rock drill apparatus 24 are inserted into, and affixed to, the apertures 18, 20. All air passages 38, such as opening 35, to an air supply 40 are placed in fluid communication with each rock drill apparatus 24 at this time.

The cannister 16 is affixed to the upper and lower plates to form an enclosure to restrict debris and abrasives from contacting the majority of the rock drill apparatus 24. Drill bits 39 extend between the second plate portion 14 and laterally of the cannister 16. The cannister may be formed either circumferentially as illustrated in FIG. 3, or with radially extending protuberances 41 to accommodate the rock drill apparatus 24 as illustrated in FIG. 4.

FIG. 1 illustrates the cluster drill apparatus 10 being used in a downward drilling configuration. A rotary drill shaft 60 is affixed to the cluster drill apparatus 10 on the location opposed to the second plate portion 14. The rotary drill shaft 60 imparts rotary motion and forward pressure to the cluster drill apparatus 10. Air is applied via conduit 62 in the rotary drill shaft 60 to the air supply 40.

FIG. 2 illustrates the cluster drill apparatus 10 being used in the reaming configuration. A rotary reamer shaft 66 is affixed to the cluster drill apparatus 10 on the same side of the cluster drill apparatus 10 as the second plate portion 14. The rotary reamer shaft 66 imparts rotary motion and reversed pressure to the cluster drill apparatus 10. Air is applied via conduit 68 in the rotary reamer shaft 66 to the air supply.

Figure 6:
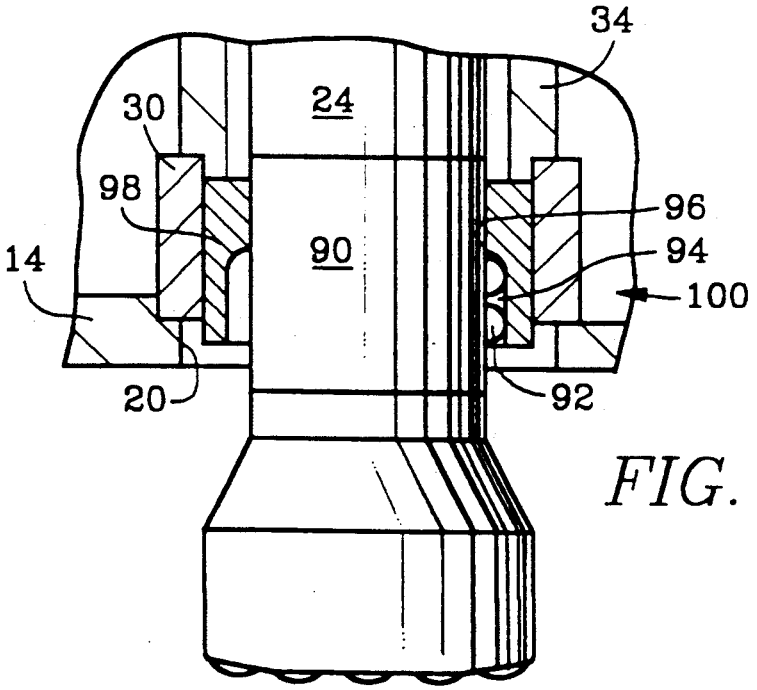
FIG. 6 is an exploded side cross sectional view illustrating the attachment means to the lower plate portion illustrated in FIG. 1.

If the rock drill chuck 90 is formed with button elements 92, as illustrated in FIG. 6, then grooves 94 may be formed on an interior surface 96 of a bushing 98 located adjacent the second attachment mean 30. The button elements 92 interact with the groove 94 and the bushing 98. In this manner, the button elements 92 and the groove 94 produce a drill chuck lock 100 which restricts relative motion between the drill chuck 90 and the modular retainer unit 22 to restrict unscrewing of the drill chuck 90.

While this invention has been illustrated and described in accordance with a preferred embodiment, it is recognized that other variations and changes may be made therein without departing from the invention as set forth in the claims.

Having described the invention, what is claimed is:

1. For use in a cluster drill, a modular retainer means comprising:

a first attachment means at a first end of the retainer means for retaining a first portion of a rock drill apparatus therein and for attachment to a first plate portion of the cluster drill;

a second attachment means at a second end of the retainer means for retaining a second portion of the rock drill apparatus therein and for attachment to a second plate portion of the cluster drill; and tubular cannister means for interconnecting the first attachment means and the second attachment means.

2. The modular retainer means as described in claim 1, wherein the modular retainer means is contained within the tubular cannister means.

3. The modular retainer unit as described in claim 1, wherein the tubular cannister means is cylindrical.

4. The modular retainer means as described in claim 1, wherein the tubular cannister means contains protuberances about the periphery to accommodate the modular retainer means.

5. The modular retainer means as described in claim 1, wherein the first plate portion contains a first plate aperture which the first portion extends into.

6. The modular retainer means as described in claim 1, wherein the second plate portion contains a second plate aperture which the modular retainer unit extends into.

7. For use in a cluster drill, a modular retainer means comprising:

a rock drill apparatus mounted in the modular retainer means;

a first attachment means at a first end of the retainer means for retaining a first portion of the rock drill apparatus therein and for attachment to a first plate portion of the cluster drill;

a second attachment means at a second end of the retainer means for retaining a second portion of the rock drill apparatus therein and for attachment to a second plate portion of the cluster drill; and tubular cannister means for interconnecting the first attachment means and the second attachment means.

8. The modular retainer unit as described in claim 7, wherein the rock drill apparatus includes a drill bit, further comprising:

a drill bit lock which restricts relative motion between a drill chuck and the modular retainer unit.

9. For use in a cluster drill, a modular retainer means comprising:

a rock drill apparatus mounted in the modular retainer means;

a first plate portion;

a second plate spaced from the first plate portion;

a first attachment means at a first end of the retainer mean for retaining a first portion of the rock drill apparatus therein and for attachment to the first plate portion;

a second attachment means at a second end of the retainer means for retaining a second portion of the rock drill apparatus therein and for attachment to the second plate portion; and tubular cannister means for interconnecting the first attachment means and the second attachment means.

10. For use in a cluster drill, a modular retainer means comprising:

a rock drill apparatus mounted in the modular retainer means;

a first plate portion;

a second plate spaced from the first plate portion;

a tubular cannister portion interconnecting the first plate portion and the second plate portion, the modular retainer means being mounted within the cannister;

a first attachment means at a first end of the retainer means for retaining a first portion of the rock drill apparatus therein and for attachment to the first plate portion;

a second attachment means at a second end of the retainer means for retaining a second portion of the rock drill apparatus therein and for attachment to the second plate portion; and tubular cannister means for interconnecting the first attachment means and the second attachment means.

11. The modular retainer means as described in claim 10, wherein the tubular cannister means is cylindrical.

12. The modular retainer means as described in claim 10, wherein the tubular cannister means contains outwardly extending protuberances which accommodate the rock drill apparatus.

13. The modular retainer as described in claim 10, wherein the first plate portion consists of a plurality of plates with a void formed therebetween, air is supplied through the void to the rock drill apparatus.

* * * * *